US006044668A

United States Patent [19]

Conti

[11] Patent Number: 6,044,668

[45] Date of Patent: Apr. 4, 2000

[54] METHOD AND MECHANISM FOR CLOSING THE TOE AT THE START OF THE PROCESS OF MAKING A STOCKING OR SOCK, IN A CIRCULAR KNITTING MACHINE

[75] Inventor: Paolo Conti, Florence, Italy

[73] Assignee: Golden Lady S.P.A., Italy

[21] Appl. No.: 09/171,754

[22] PCT Filed: Apr. 28, 1997

[86] PCT No.: PCT/IT97/00097

§ 371 Date: Oct. 21, 1998

§ 102(e) Date: Oct. 21, 1998

[87] PCT Pub. No.: WO97/41288

PCT Pub. Date: Nov. 6, 1997

[30] Foreign Application Priority Data

Apr. 29, 1996 [IT] Italy ..... FI96A0087

[51] Int. Cl.[7] ..... D04B 9/56

[52] U.S. Cl. ..... 66/148

[58] Field of Search ..... 66/147, 148, 149.5, 66/151, 21, 22, 13, 184, 186, 187, 58, 18

[56] References Cited

U.S. PATENT DOCUMENTS

| | | | |
|---|---|---|---|
| 5,052,196 | 10/1991 | Turini | 66/149 S |
| 5,231,856 | 8/1993 | Lonati et al. | 66/147 |
| 5,617,744 | 4/1997 | Conti | 66/148 |
| 5,647,229 | 7/1997 | Conti | 66/58 |
| 5,924,309 | 7/1999 | Conti | 66/148 |

FOREIGN PATENT DOCUMENTS

| | | | |
|---|---|---|---|
| 2045000 | 2/1971 | France | 66/148 |
| 9531595 | 11/1995 | WIPO | 66/148 |
| 9534702 | 12/1995 | WIPO | 66/148 |

*Primary Examiner*—Danny Worrell
*Attorney, Agent, or Firm*—McGlew and Tuttle, P.C.

[57] ABSTRACT

The fabric (T) for the toe pouch is first formed by the needles (1) of a first semicircle (A), and then, in order to transfer the initial free edge (T1) of said pouch (T) to the needles of the complementary arc and thus to start the tubular fabric, a region of concentrated suction of air is created by of a mouth (22) extending around the inside of a portion of the needle circle in order to capture said free edge of the pouch in transit; next, by a centrifugal movement of sinkers each provided with a spike, said free edge (T1) is moved progressively out beyond the circle of the needles, which rise and pass through the fabric (T) around said initial edge (T1).

20 Claims, 18 Drawing Sheets

11
9B
9A
9
17
40
7
36
13A
38
38A
5
13
1
3

METHOD AND MECHANISM FOR CLOSING THE TOE AT THE START OF THE PROCESS OF MAKING A STOCKING OR SOCK, IN A CIRCULAR KNITTING MACHINE

BACKGROUND ART

In circular machines for producing stockings or socks, one of the methods for closing the toe of the garment directly inside the machine that produces the latter is to start its formation with the toe itself, i.e. the foot, rather than with the cuff or upper edge; after the formation of a series of stitches to start the article, only an arc of needles, approximately corresponding to one half of the circumference of the cylinder, is employed to make the portion of fabric that will form the toe of the garment, after which the free edge of said portion of fabric is transferred to and over the needles of the opposite arc of needles corresponding to the remaining semicircle of the cylinder. This transfer may take place in two stages: in the known methods it is initiated in the first place by mechanical members that grip the fabric to be transferred and position it in such a way that, in the second stage, other mechanical members intervene on it to complete its transfer to the needles of the opposite arc, which proceed to "knit it into" the tubular portion of the article, the manufacture of which proceeds from this moment onward. However, this necessarily involves a not insignificant complexity of the mechanism necessary for carrying out the operations indicated above, and of the mechanical members of which this mechanism is composed.

DISCLOSURE OF THE INVENTION

The present invention, by contrast, greatly reduces the complexity of the mechanical members necessary for achieving this transfer of the portion of fabric that is to form the toe of the garment, while offering other results and advantages that will be clear from a perusal of the following text.

According to the present invention, then, the first stage of the transfer of the portion of fabric that is to form the toe of the garment is effected by utilizing the pneumatic suction system—generally present in circular machines for the purpose of take-down and tensioning of the article during its production—in order to create a region of concentrated suction of air, that is to say a concentrated suction stream, around the semicircle of needles where said portion of fabric is to be formed, and, therefore, around the free edge of this portion. Since the cylinder of the machine - depending on the case—is driven with a continuous rotary motion, or its rotary motion is reversed each time it has turned through an arc of 180°, and since, on the other hand, the orifice through which the abovementioned suction stream enters is in a fixed position, the free edge of the portion of fabric to be transferred comes close to said pneumatic suction stream, is captured by it and is progressively moved toward the arc of the needle circle opposite the arc where this portion of fabric was formed.

At the end of said first stage of the transfer —which was carried out by making use of the suction of air—mechanical members come into action, consisting of radially movable sinkers provided with spikes by means of which they engage the free edge of the fabric pouch intended to form the toe of the sock or stocking, and carry it radially out beyond the circle of the needles, which rise up through it to "knit it into" the series of stitches with which the article was started and, therefore, into the tubular portion of the garment, which is formed thereafter.

In practice, in order to create the region of concentrated suction of air, or concentrated suction stream, a mouth is provided that is connected by a tube to the pneumatic suction system referred to earlier, and in particular to the pipe that forms part of this system, with a valve also being provided to close this pipe so that all the suction draft goes through the mouth specified immediately above.

As an alternative to the above, said region of concentrated suction may be produced by providing a flat, elastically bendable component capable of being moved so as to cover the inlet orifice of the pneumatic tensioning system, with the exception of a slot defined by a cutout in said flat component, said slot forming a region of concentrated suction of air.

To accomplish the second stage, progressively moving the free edge of the initial fabric that is to form the toe of the garment, out past the needle circle, sinkers may be arranged in the needle arc to which the free edge of this portion of fabric must be carried, and each provided with an upwardly-directed spike. Since said sinkers are not only radially movable but also raisable from their tricks, the present invention provides that, during a centrifugal movement of the sinkers, their spikes project out and penetrate the free edge of the fabric that is being transferred, and that their centrifugal (radial) movement pulls the fabric until it comes just over the needle circle. For this purpose each of the sinkers has a downward projection on its end inside the cylinder which is acted on by the shaped bottom of its sinker trick so that it is raised during its centrifugal movement. Alternatively, each of said movable sinkers may be able to tilt in its trick and is lowered at its outermost end at the start of or immediately before its supplementary centrifugal movement.

BRIEF DESCRIPTION OF THE DRAWINGS

The invention will be understood more clearly from the description and accompanying drawing, which latter shows a practical, non-restrictive example of an embodiment of the invention. In the drawing.

DETAILED DESCRIPTION OF PREFERRED EMBODIMENT

Figure 1:
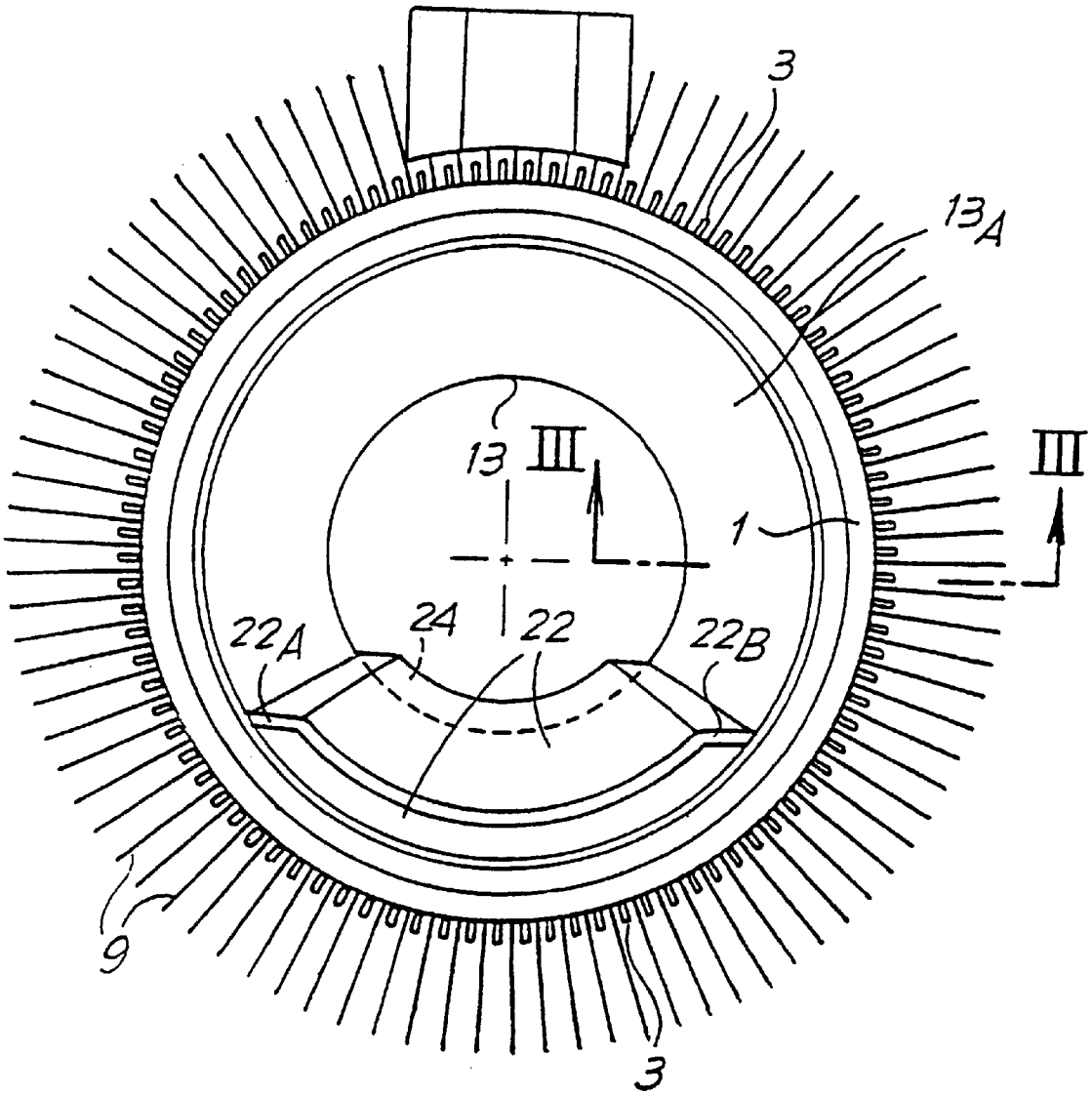
FIG. 1 is a schematic plan view with the arrangement for the suction around the inside of the needle circle.

As illustrated in FIGS. 1 through 13 in the accompanying drawing, the numeral 1 indicates the needle cylinder with longitudinal tricks in which the needles 3 move; in a fixed ring 5 surrounding the upper end of the needle cylinder are radial tricks 7 in which the sinkers 9 move as they cooperate with the needles to form the fabric. 11 indicates the disk having hooks designed to cooperate with the needles and with the sinkers, in conventional versions of circular knitting machines for producing tubular structured articles such as stockings, socks and the like. 13 indicates the conventional tube for applying suction to the article during its formation in order to tension said article so that loop formation occurs evenly; the suction tube 13 possesses an upper end portion 13A in the form of a funnel-shaped orifice level with the working area of the needles. In order to put the invention into practice the tube 13 with its orifice 13A does not move with the revolving system of the needle cylinder 1. Sketched in in some of the figures are cams 15 for operating the needles 3 and cams 17 for radial operation of the sinkers 9, all of which is conventional In combination with said fixed suction pipe 13, 13A for the conventional tensioning of the article during formation, there is provided, according to the invention, on the inside of the needle 3 circle, an elongate arcuate mouth 22, as shown clearly in FIG. 1, which defines a region of concentrated suction of air, and which is defined by end parts 22A and 22B joining it to the pipe 13 and its orifice 13A. The elongate suction mouth 22 is continued in the form of an extra pipe 24 in which, as indicated below, a concentration of the suction draft can be set up through said elongate and arcuate mouth 22.

Figure 14:
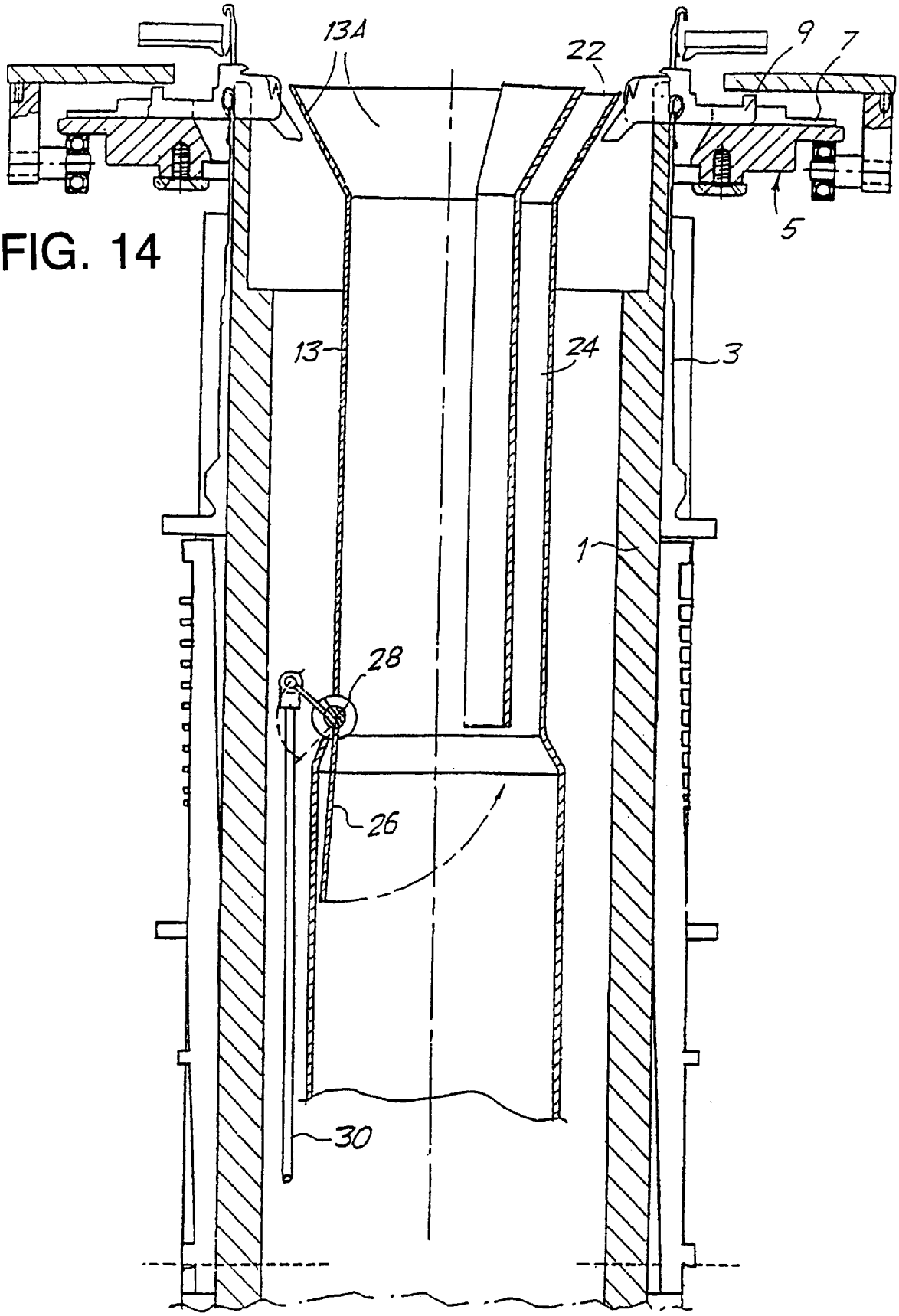
FIGS. 14 and 15 show a way of switching the suction for the transfer operations.
Figure 15:
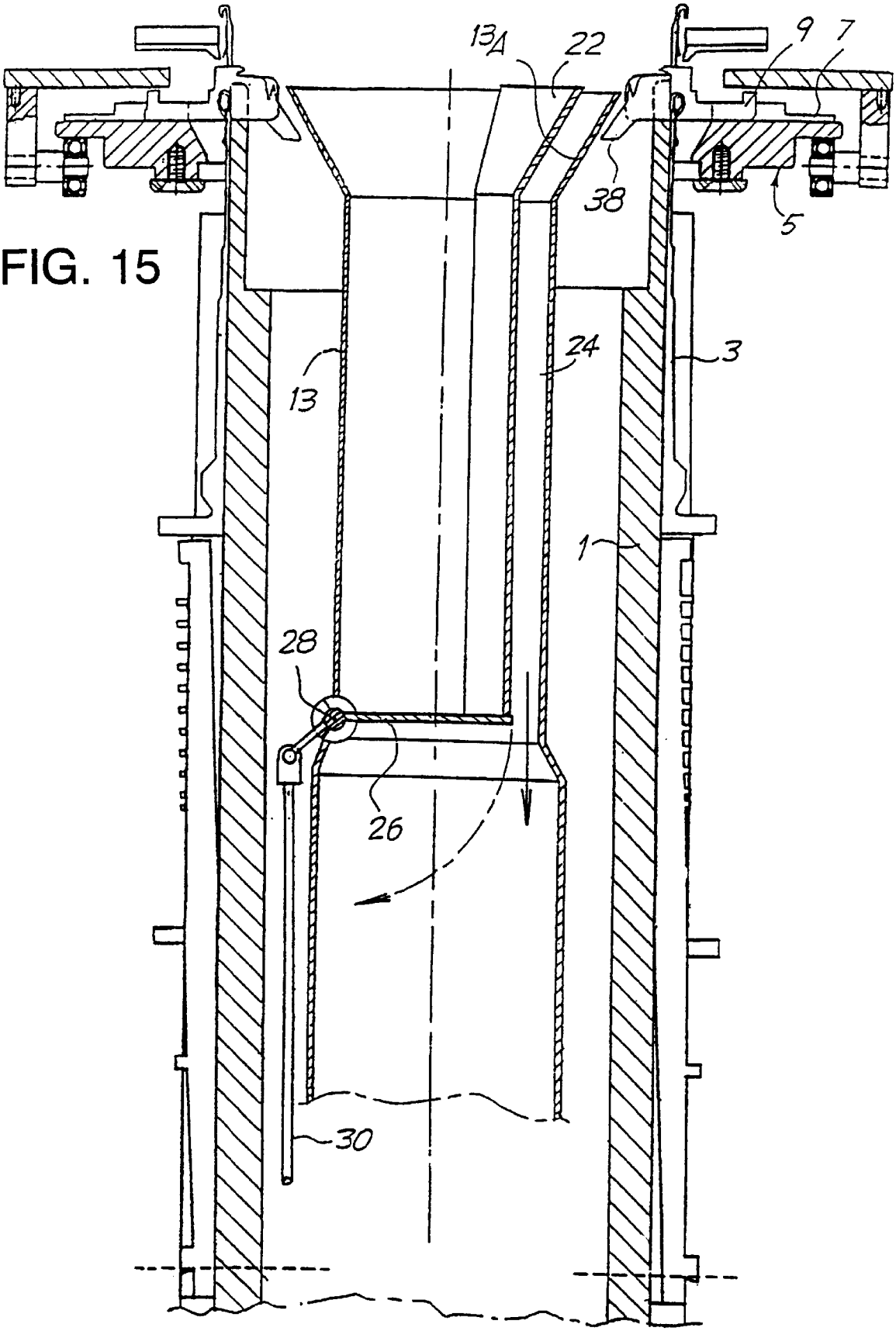
Figure 17:
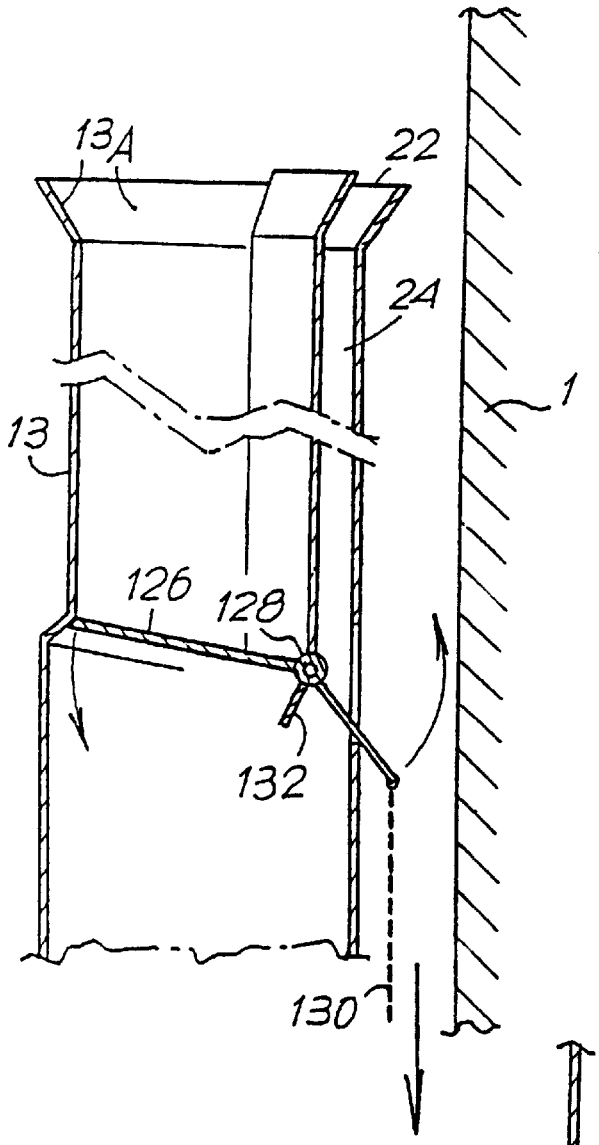
FIGS. 16 and 17 show, in a similar way to FIGS. 14 and 15 but with fewer details and more partially, an alternative embodiment to that of FIGS. 14 and 15.
Figure 16:
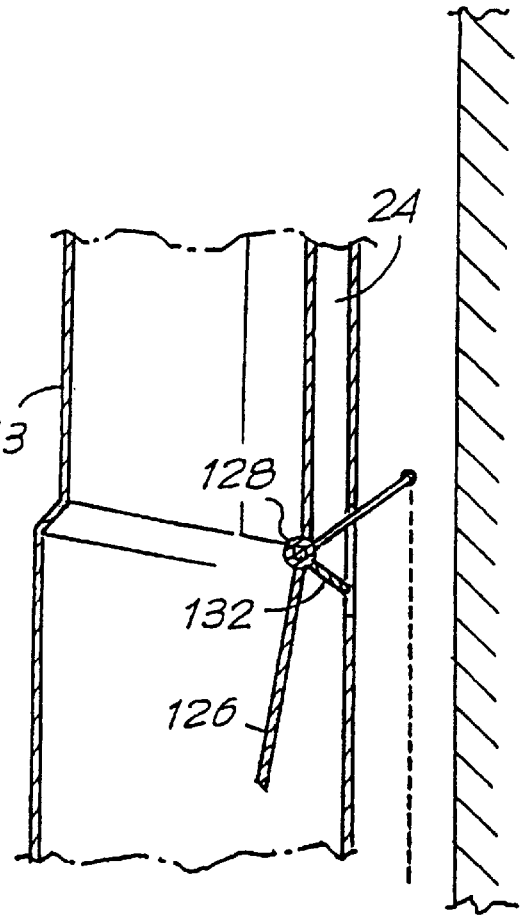

In order to produce the suction in the pipe 13 for conventional pneumatic tensioning of the fabric as it is formed, and to produce a concentrated suction through the mouth 22 by shutting off the suction through the pipe 13, 13A, an arrangement may be adopted as shown in FIGS. 14 and 15 which show a disk valve 26 hinged at 28 and operated by a link 30 to open the pipe 13 as shown in FIG. 14 and close said pipe 13 as shown in FIG. 15. In the position shown in FIG. 14, suction can also occur (but very partially) through the extra pipe 24 and the mouth 22, but when the valve 26 closes off the main suction pipe 13 the suction is concentrated in the extra pipe 24, with the result that there is powerful suction through the mouth 22 for the purposes indicated below. An alternative embodiment is shown in FIGS. 16 and 17, in which a valve 126, equivalent to the valve 26, is hinged at 128 adjacent to the extra pipe 24 and is operated by a link 130; in this version a shaped guard 132 is rigidly attached to the valve 126 but at an angle to the latter; the arrangement is such that in the open position of the valve 126 (FIG. 16) the pipe 24 is closed by the guard 132, so that there is switching of the suction rather than a variation of its strength in the pipe 24.

Figure 20:
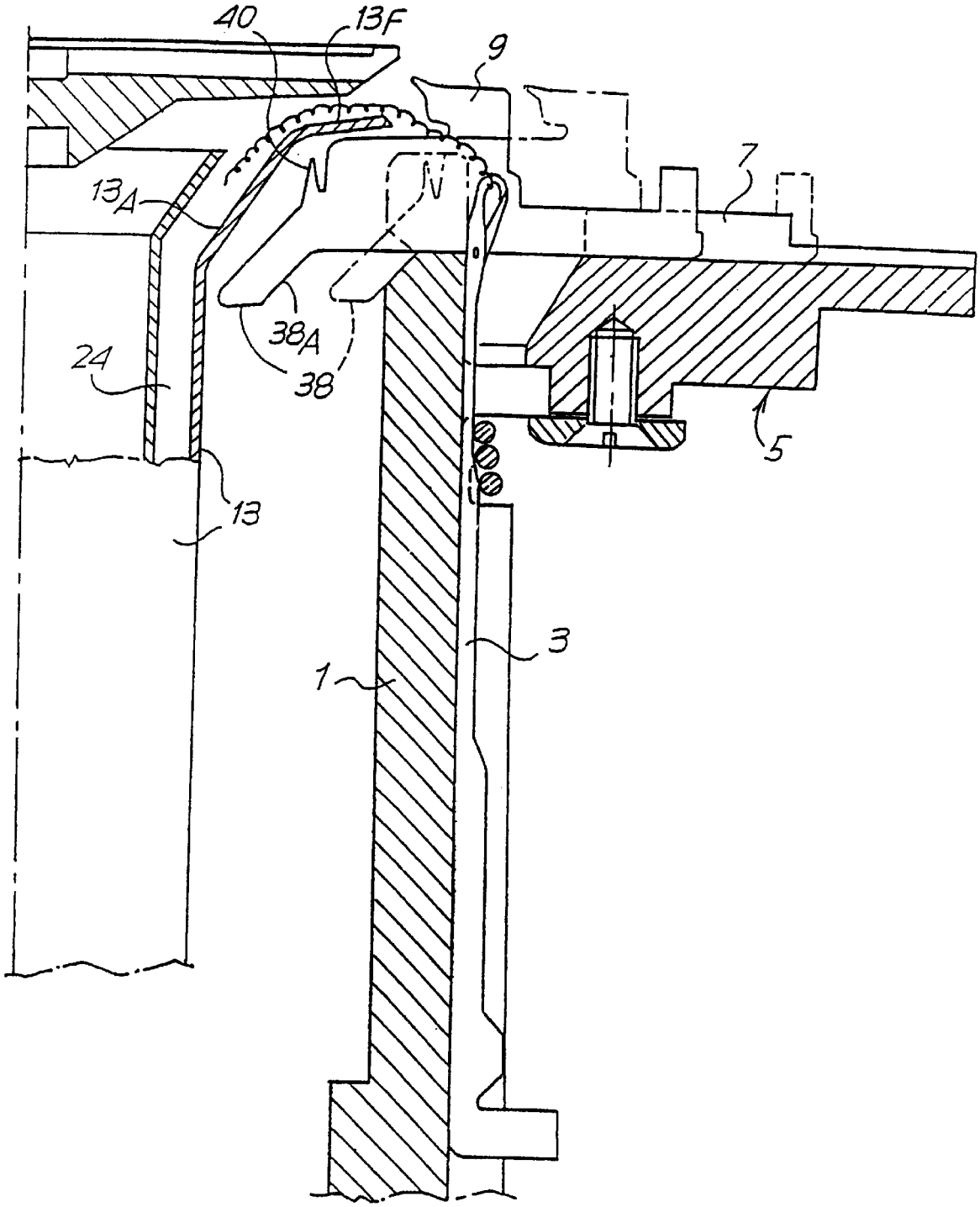
FIG. 20 shows a modification to the arrangement of FIGS. 1 through 5.

In the version shown in FIGS. 1 through 18, the cylinder 1 has walls 36 corresponding in position to the sinker 9 tricks 7: these walls extend inward to protect the sinkers 9 (a variant is shown in FIG. 20). The sinkers 9 have the conventional throats 9A and the conventional surfaces 9B by which they cooperate with the needles during the formation of the knitted fabric. The sinkers of at least a semicircle, whose needles are to commence working after the toe pouch has been produced, have a projection 38 at their forward end that slopes down toward the center of the cylinder to be acted upon by the end of the bottom of the trick 7 in which that particular sinker moves; its centrifugal movement, i.e. in the direction of arrow fC as marked in FIGS. 4 and 5—beyond a certain limit to which it moves for conventional operation—brings about a lifting of the front end of the sinker, as will be seen by comparing FIGS. 2 and 3 with FIGS. 4 and 5. This additional movement in the direction of arrow fC by the sinkers can be produced by a special cam that is shaped so as to bring about the centrifugal retraction in the direction of arrow fC and also the tilt of the sinker, which rises. Each sinker 9 of said semicircle that comes into operation after the production of the toe also possesses (see FIG. 18 in particular) a shaped upward spike 40 situated immediately next to the surface 9B at the opposite end from the throat 9A. This spike 40 is kept out of the way between the walls 36 during normal operation of the sinker in the positions shown in FIGS. 2 and 3, but projects out when the sinker is raised by the action of the projection 38 and in particular of its edge 38A against the innermost extremity 7A of the sinker trick 7.

Figure 18:
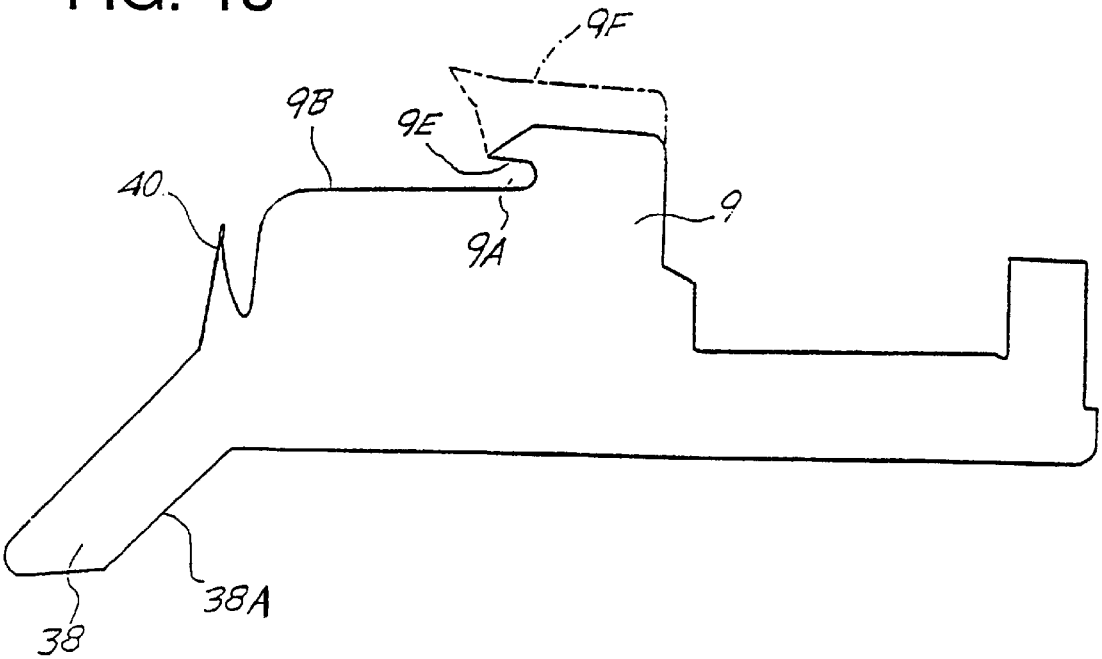
FIG. 18 is an isolated view of a sinker in two alternative embodiments.

The sinkers may be of the ordinary type with a relatively low nib 9E that defines the throat 9A and is used to make the normal stitches, or with a higher nib as indicated by the chain line at 9F in FIG. 18 for making so-called terry cloth (towelling).

Figure 10:
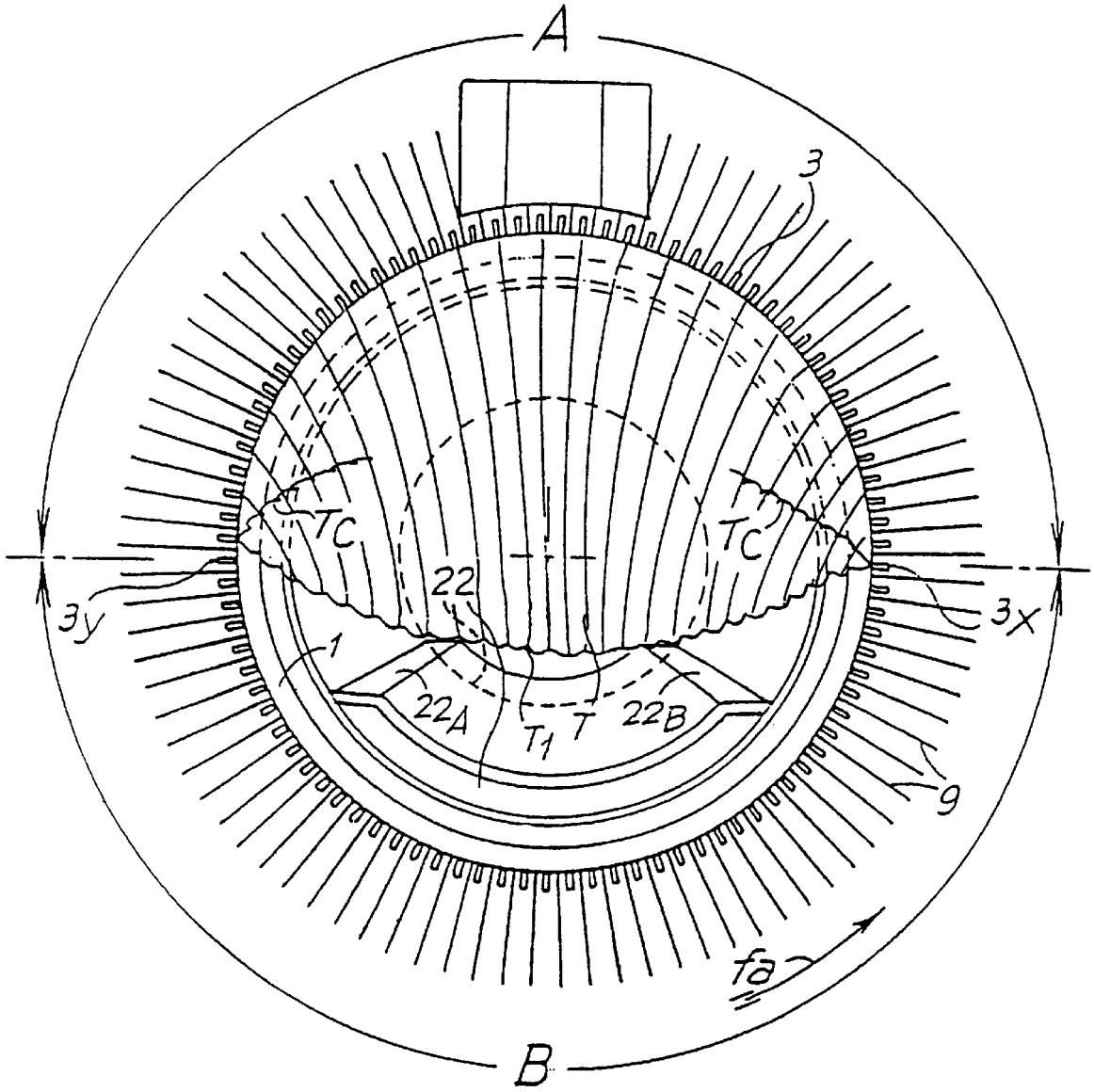
FIGS. 10 through 13 show a number of stages in the transfer operation in an axial view, i.e. in plan view.
Figure 11:
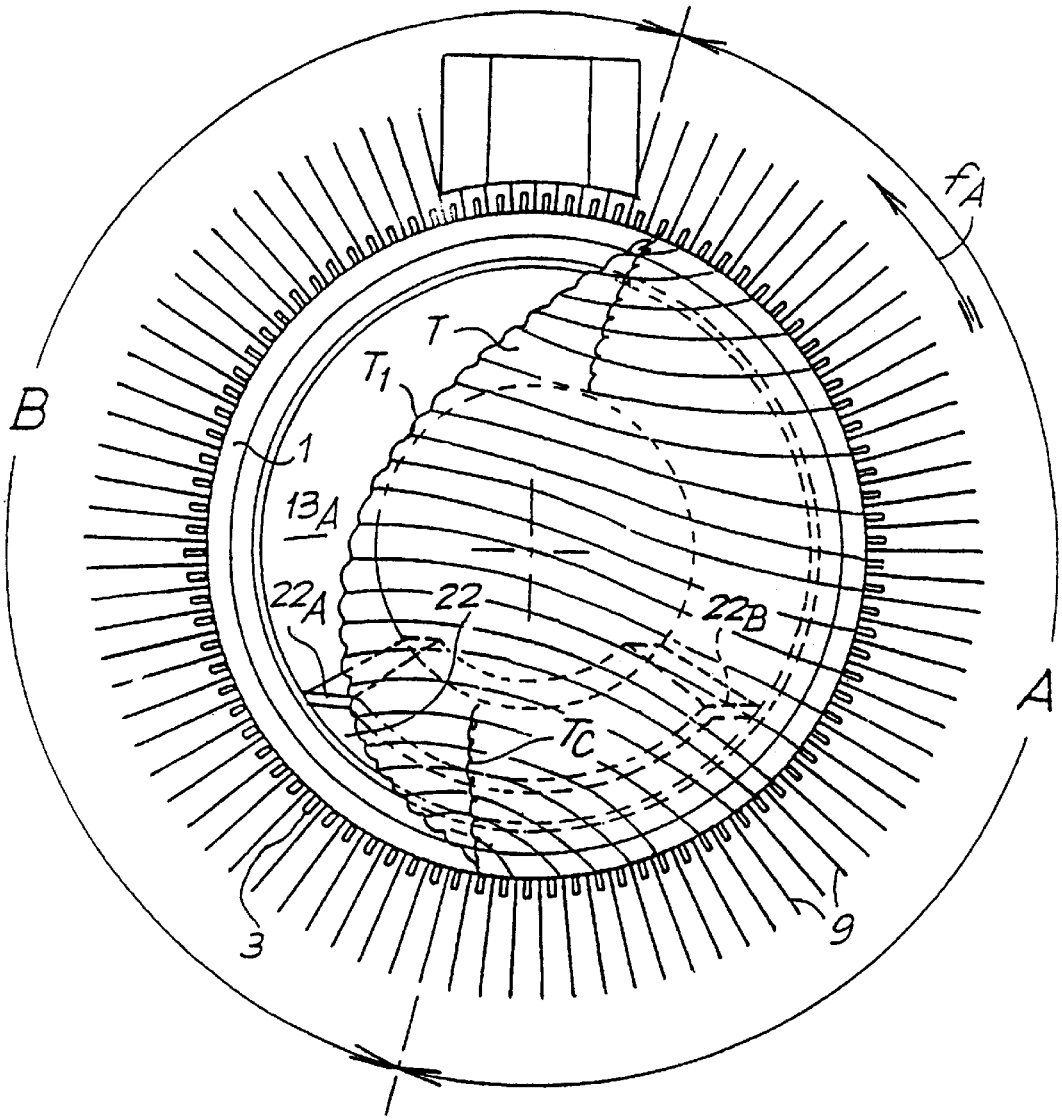

In conventional operation for producing a pouch of fabric for the toe, one or two courses of initial fabric are formed on all the needles to start the production of the article with at least one odd-numbered course of stitches 1:1 and then one even-numbered course 1:1 in a manner known per se; the machine then proceeds to form the initial edge T1 and the toe pouch fabric T on an arc of needles A that is approximately a semicircle of needles as indicated in particular in FIGS. 10 and 11. The formation of the toe pouch fabric T is achieved either by working with the reciprocating movement of the needle cylinder or by a continuous circular motion of the needle cylinder in the direction of arrow fA but activating only the needles of arc A and cutting the yarn at the ends of the partial courses which are thus progressively formed. In either case this toe fabric T is formed by making a free initial edge T1 and then the fabric T, which contains the "chains" T-C of increased and decreased courses of stitches for producing the toe pouch. The initial free edge T1 of the fabric extends—during the making of the pouch fabric T—between the two endmost needles 3X and 3Y of the arc A of working needles forming said pouch fabric T (FIGS. 6 through 13). During the formation of the fabric T, the needles of arc B opposite arc A remain lowered and engage the stitches of the initial courses of the "chain". Once the toe pouch fabric T has been completed, sufficient to form the article, the free initial edge T1 must somehow be moved over to the needles of arc B to allow it to be engaged by said needles; this is the operation effected by the mechanism which has been described and whose operation will now be explained.

Figure 2:
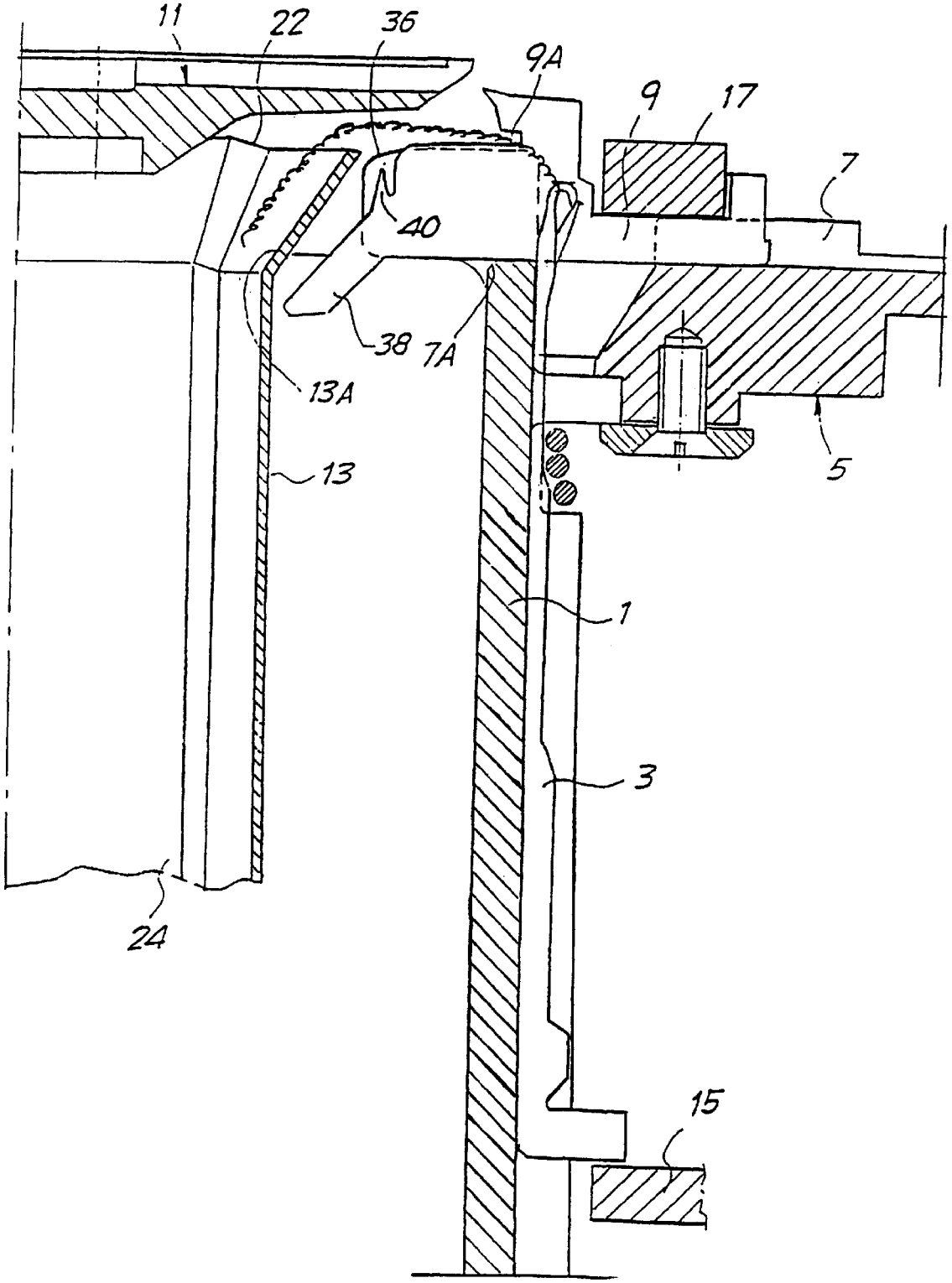
FIGS. 2 and 3 are two partial sections of the line marked III—III in FIG. 1, illustrating two active positions of the sinkers during normal working.
Figure 3:
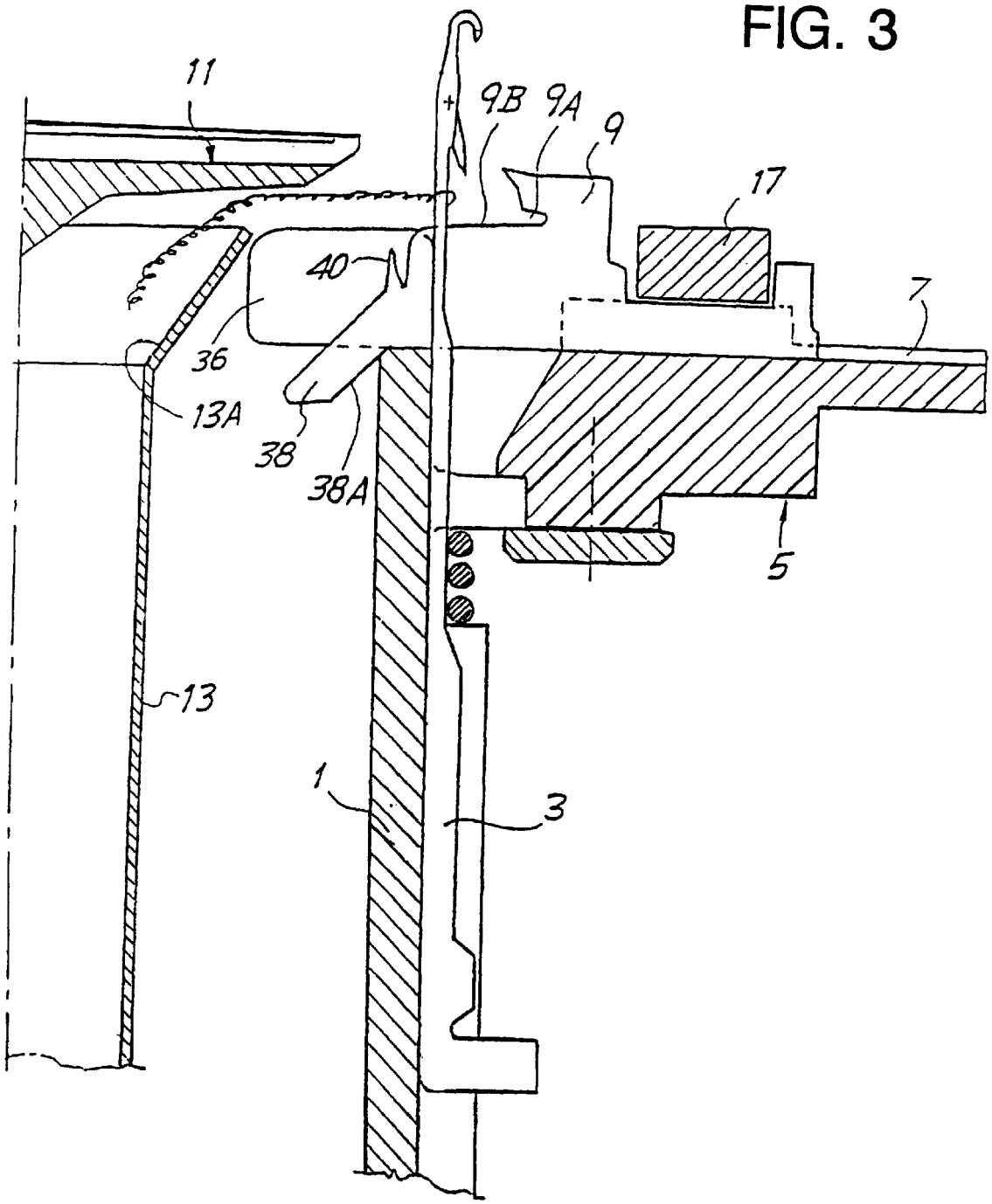
Figure 4:
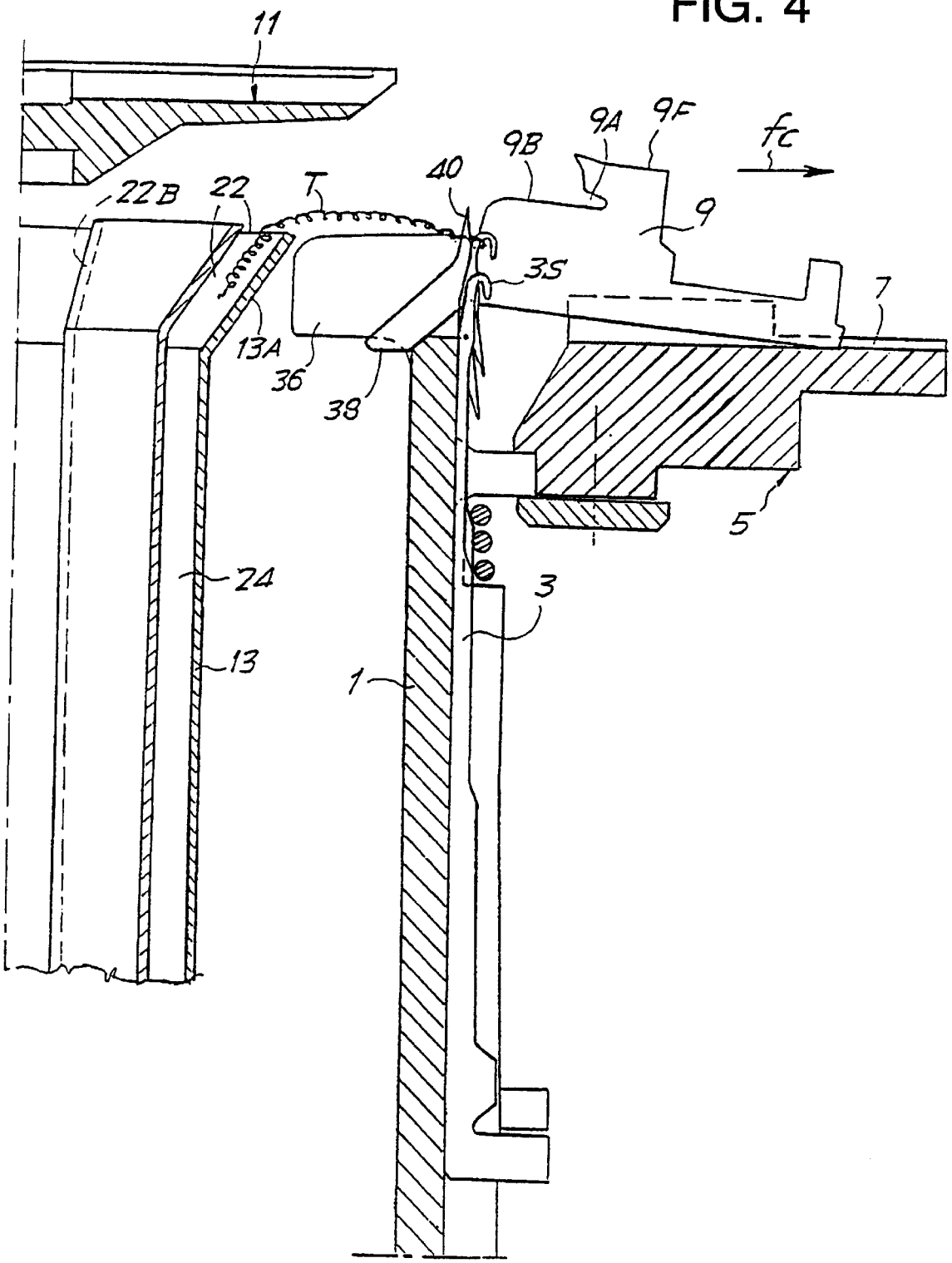
FIGS. 4 and 5 show, similarly to FIGS. 2 and 3, the position of the members at the start of and during the second stage of mechanically transferring the initial free edge of the toe fabric for engagement over the needles which are to commence tubular working.
Figure 5:
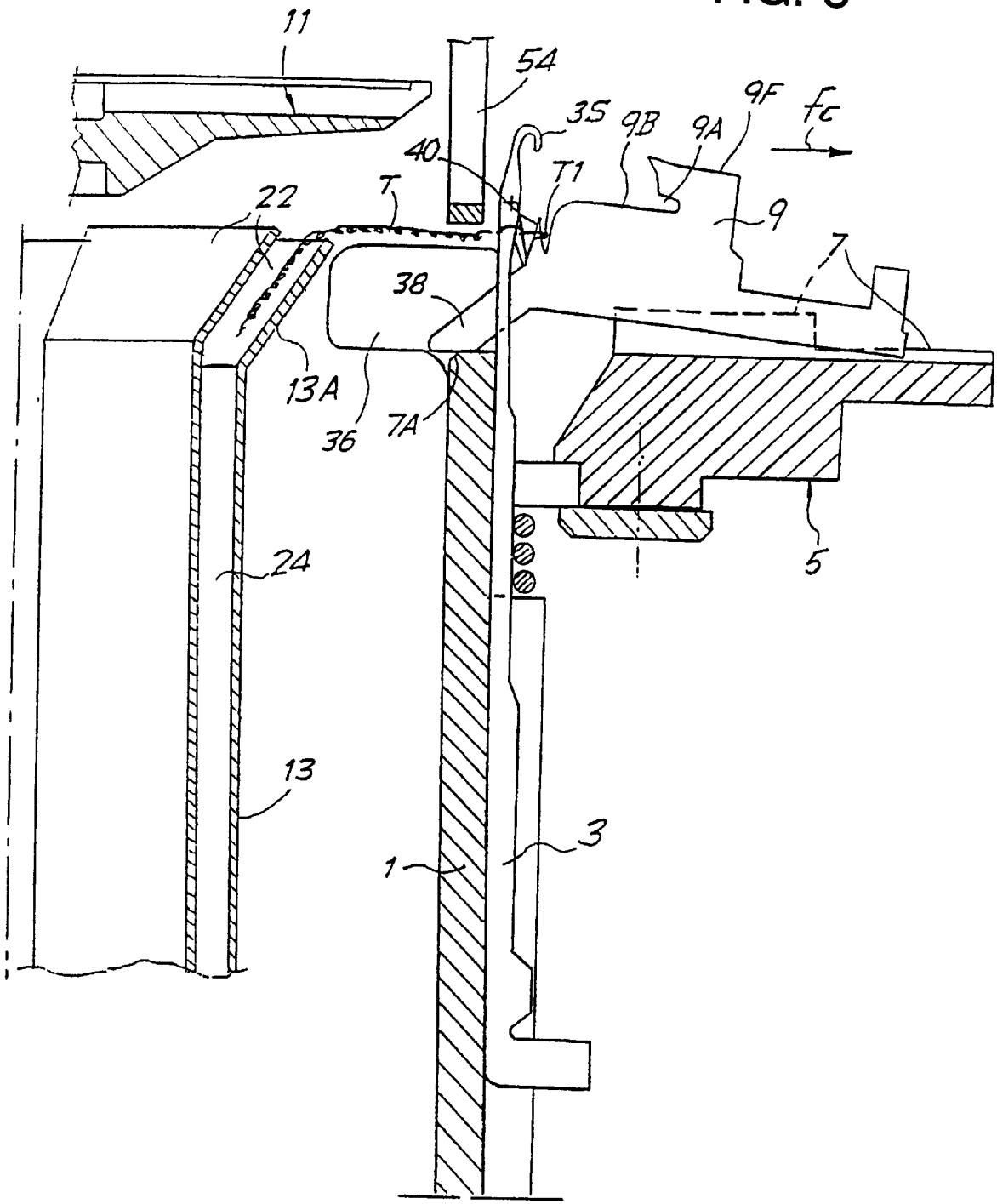
Figure 6:
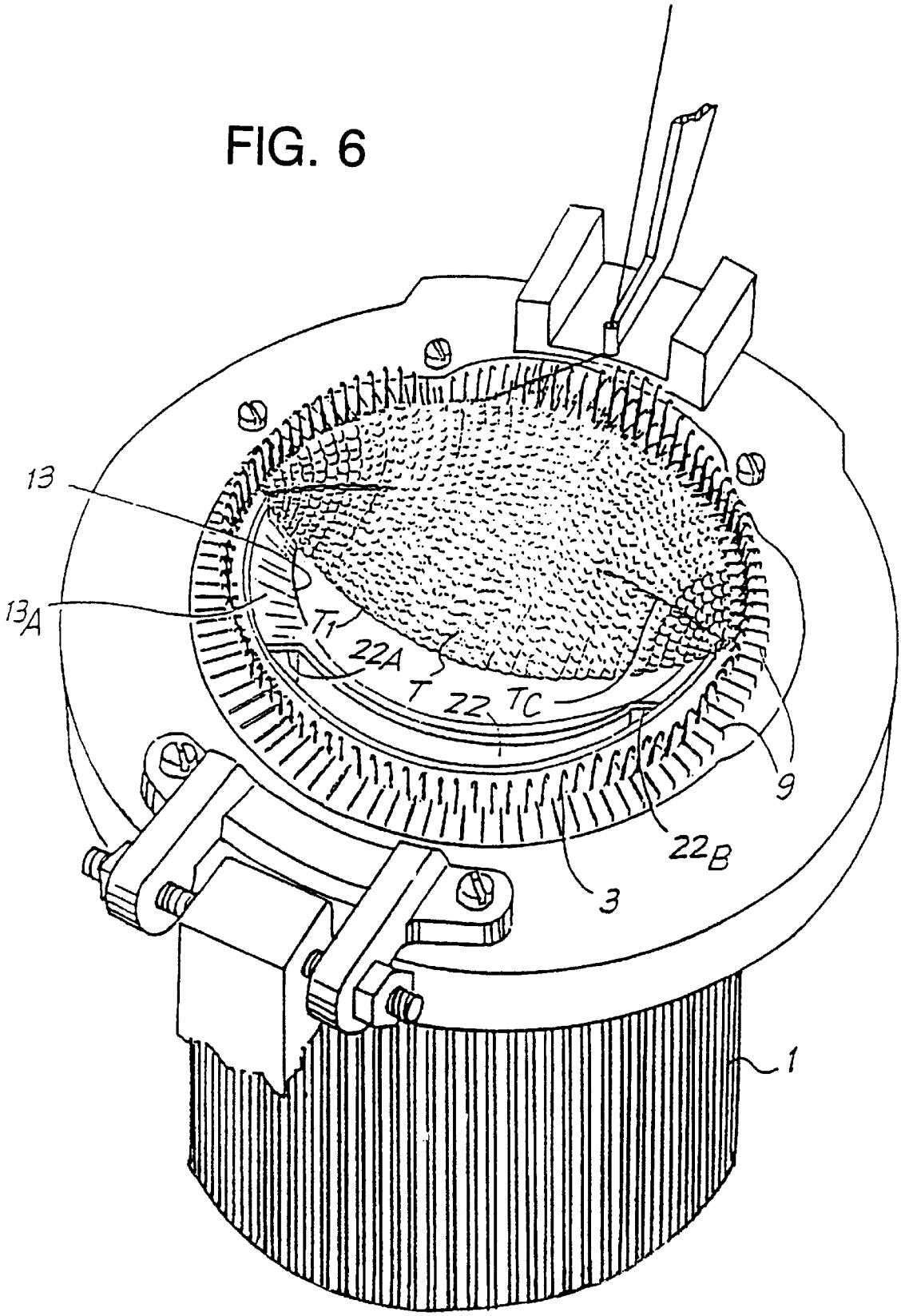
FIGS. 6 through 9 are perspective views showing successive stages in the transfer of the toe pouch fabric for engagement by the needles which are to commence tubular working.
Figure 7:
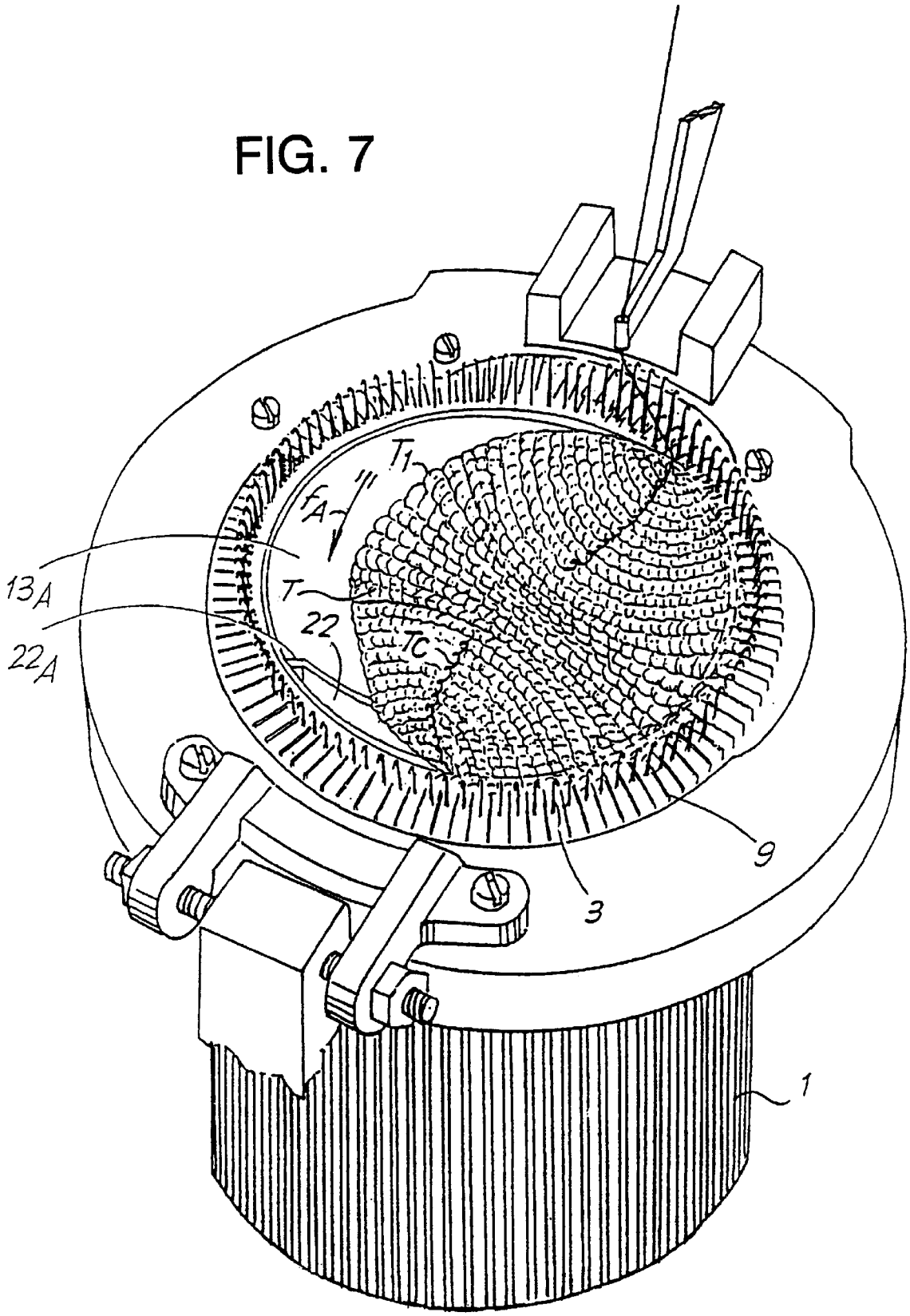
Figure 8:
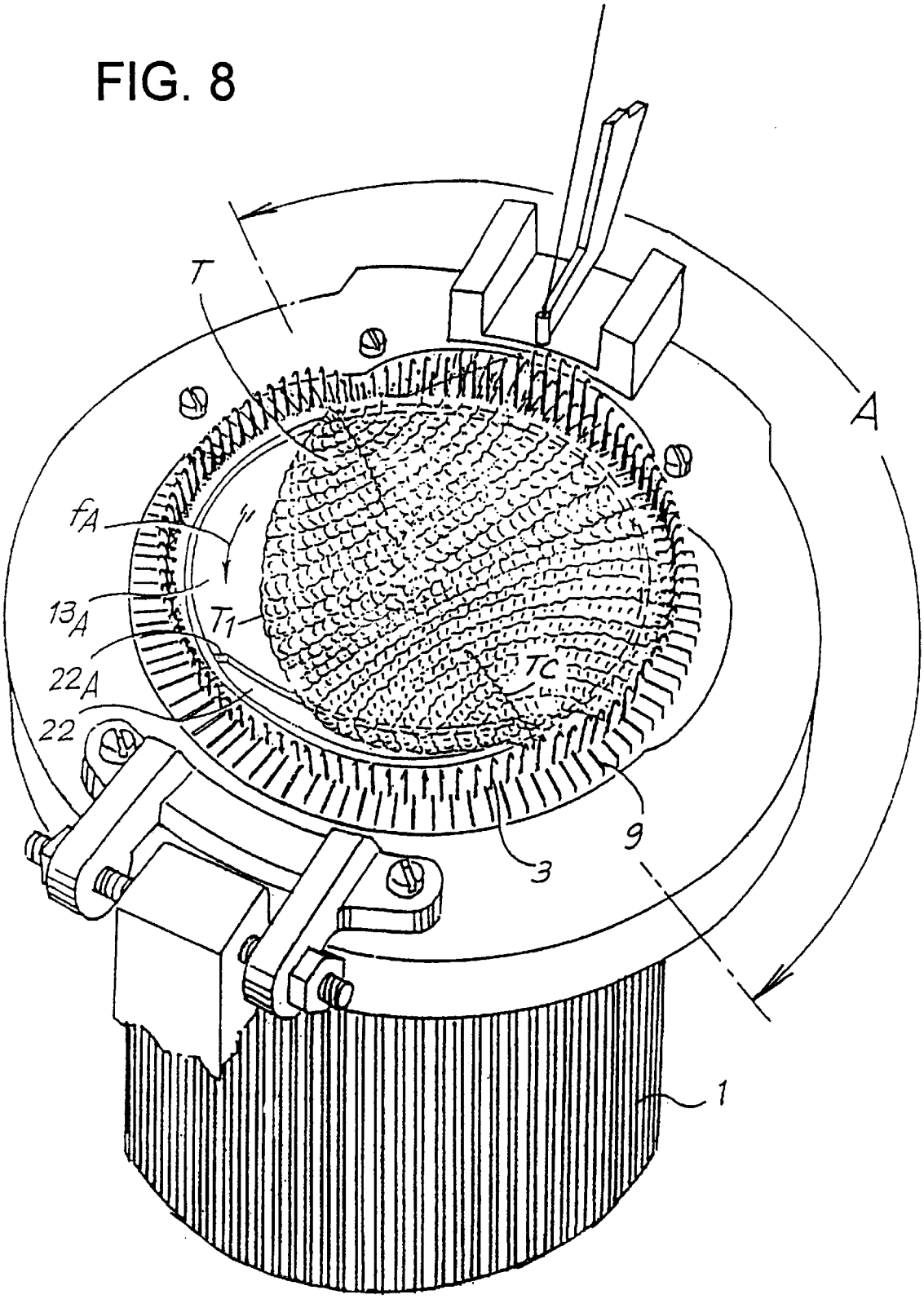
Figure 9:
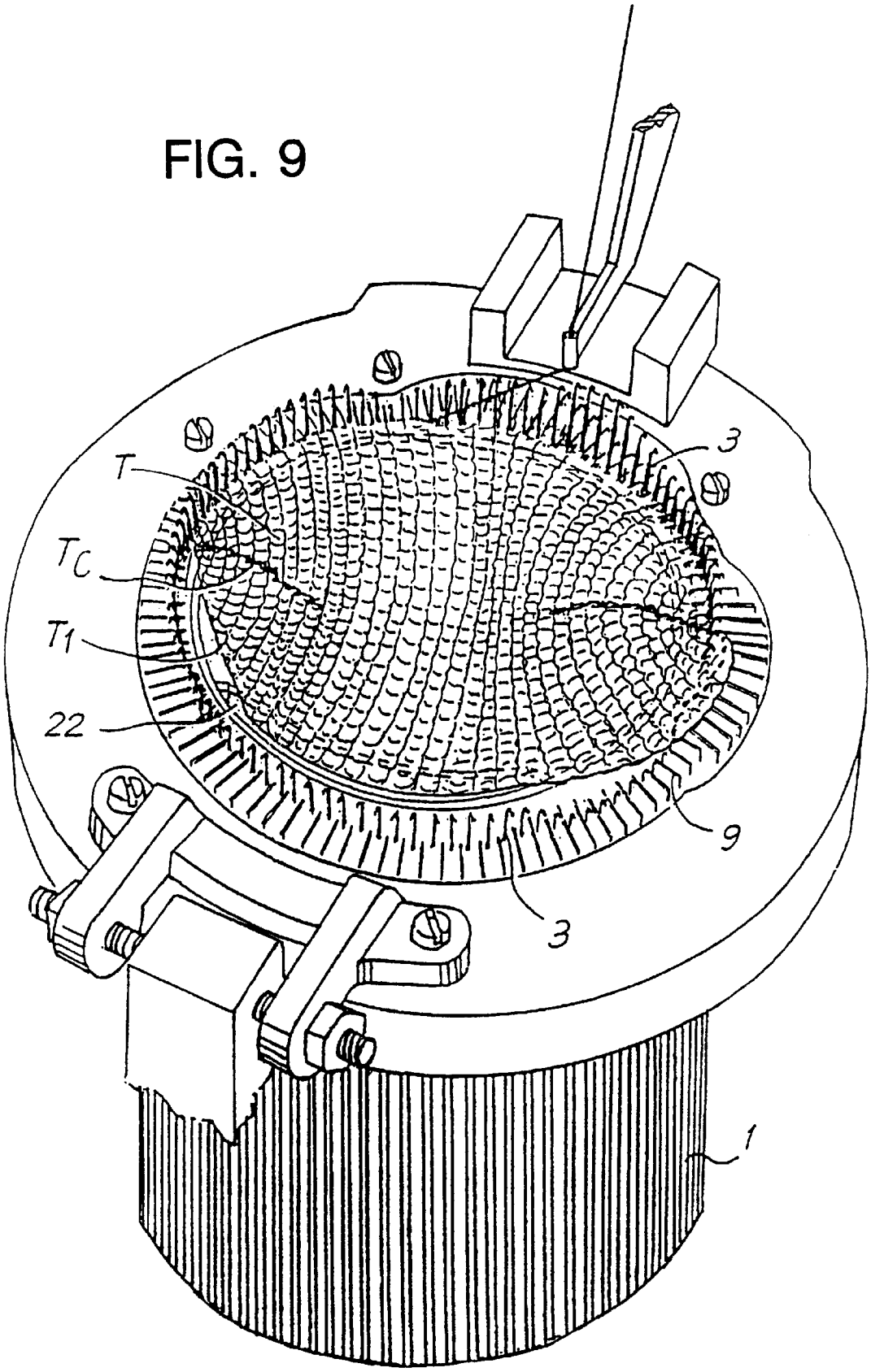
Figure 12:
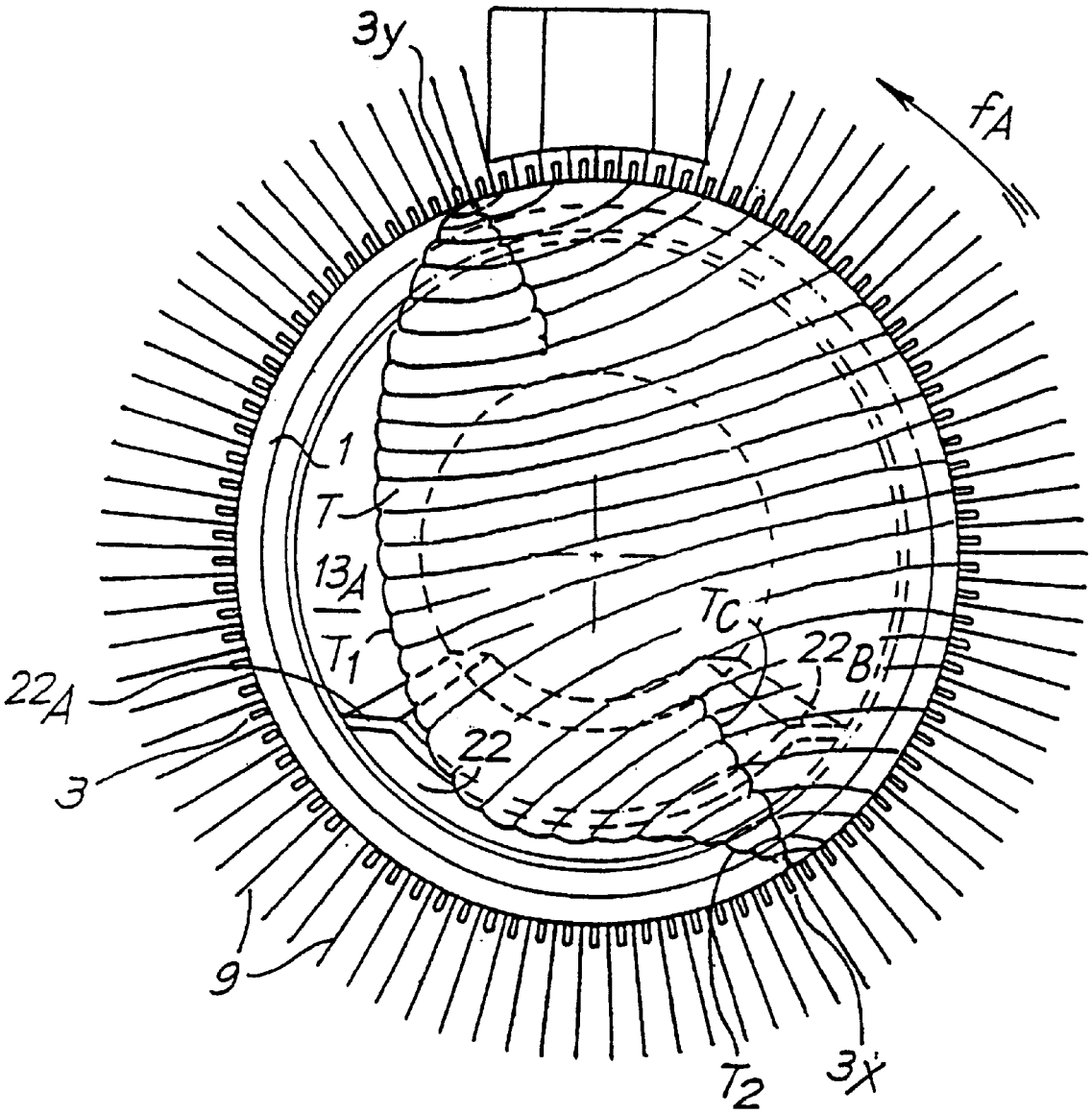
Figure 13:
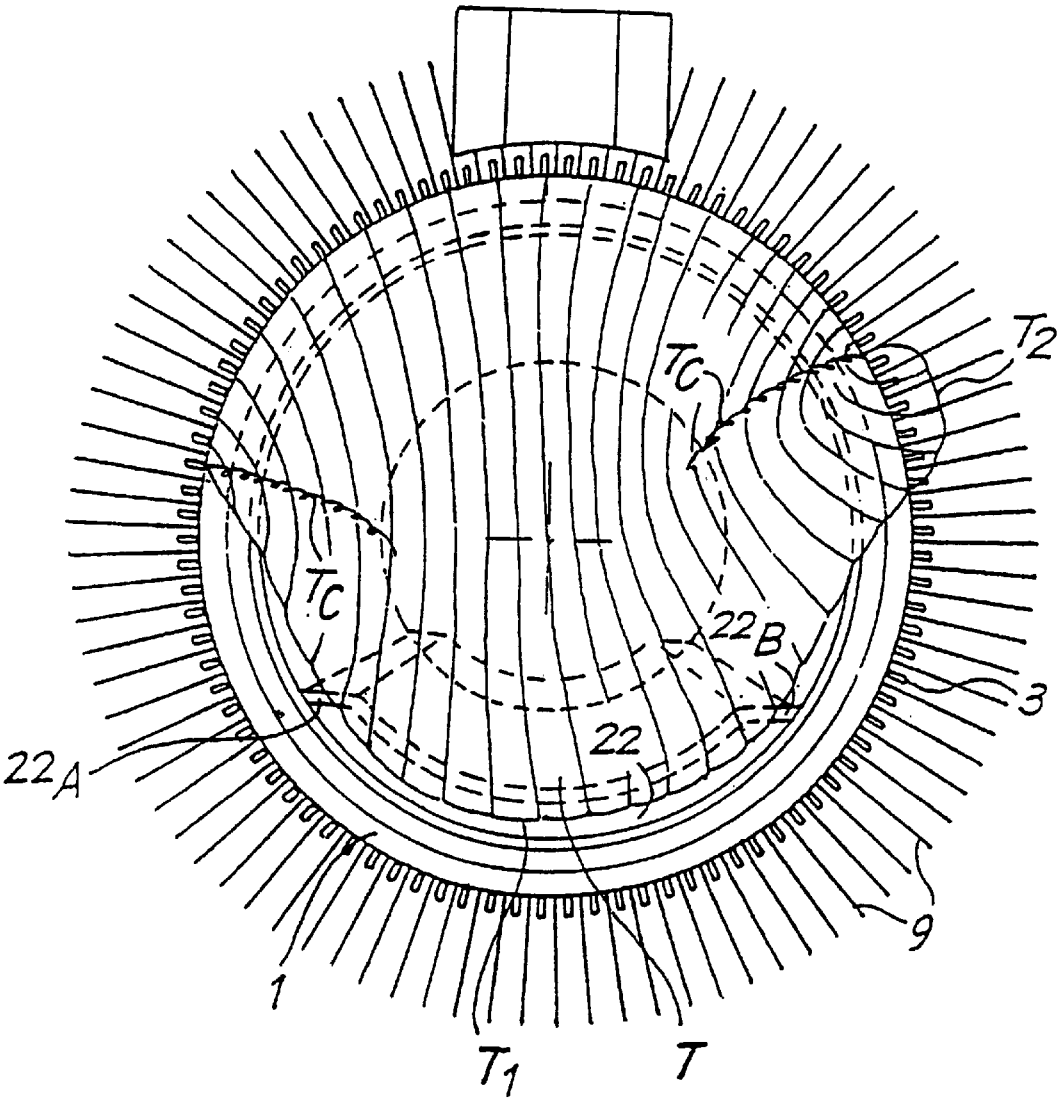

During normal operation and hence also during the production of the toe pouch, the sinkers 9 are moved between the positions indicated in FIGS. 2 and 3 and production of the toe is effected as shown in FIG. 6 and in FIG. 10. After making sufficient fabric T to create the toe (and also enough for it to be possible to carry the initial edge T1 over to the circle of needles in the area of arc B of needles, which have not been active during the formation of the pouch fabric T) , the edge 10 is transferred to a position where it can be engaged by the needles of the abovementioned arc B, in such a way that the toe is closed on the needles of said arc B. The first stage of the closure is indicated in FIGS. 7 and 11. There is then continuous rotation in the direction of arrow fA. The valve 26 is moved to close the main suction tube 13, 13A while leaving the mouth 22 open, so that there is free access of the air only to the region of concentrated suction of air through said elongate and arcuate suction mouth 22, and into the pipe 24. The end part of the initial free edge T1, which is adjacent to needle 3X, is pulled during the rotation and forced to pass over the aperture 22 which is active and producing very strong suction. It is then (FIGS. 7 and 11) that the first part of said free edge T1 is sucked as far as possible along its length, into the mouth 22. As the cylinder continues to turn in direction fA, the free starting edge T1 of the toe pouch T progressively passes over the whole of the aperture 22, with the result that it progressively enters the latter (FIGS. 8 and 12). As the cylinder continues to rotate, needle 3X on which the free edge T1 starts reaches and passes over the end 22B of the mouth 22 (FIGS. 1 and 8) so that the fabric T assumes the shape shown in FIG. 12, forming a profile T2. When needle 3X has passed the position of FIG. 12 and reached that of FIG. 13, the sinkers are moved radially out as in FIG. 4 with the result that, owing to the projections 38, the sinkers situated at the beginning of arc B after needle 3X begin to rise and tilt, as shown in FIG. 4 and FIG. 5, while the needles 1 in arc B are still down. As these sinkers rise, their spikes 40 rise and pass into the fabric T, perforating it immediately inside the edge T1 and around the profile T2 of FIGS. 12 and 13 formed between the end 22B of the aperture 22 of the suction pipe 24 and the point of attachment of the fabric to needle 3X; as the sinkers 9 continue their outward radial movement indicated by fC, they carry the starting edge T1 of the fabric T, looked over the spikes 40, out beyond the needle circle as shown in FIG. 5, so that the edge T1 is perforated and engaged by the needles of arc B, which progressively and successively rise up and penetrate the fabric T immediately inside the edge T1. This continues until the whole edge T1 has been engaged by the needles of arc B, forming fabric with the yarn fed to these needles.

The operation described above has thus succeeded in transferring the entire initial edge T1 of the toe fabric and hooking it over the needles of arc B, opposite arc A of the needles that formed this fabric T. The fabric T stretches into a disk covering the whole of the surface of the cylinder. As the continuous circular motion of the cylinder 1 continues in direction of rotation fA, the needles of both arcs A and B, all of which are now working, form the courses of tubular fabric that build up to form the rest of the stocking or sock.

Figure 19:
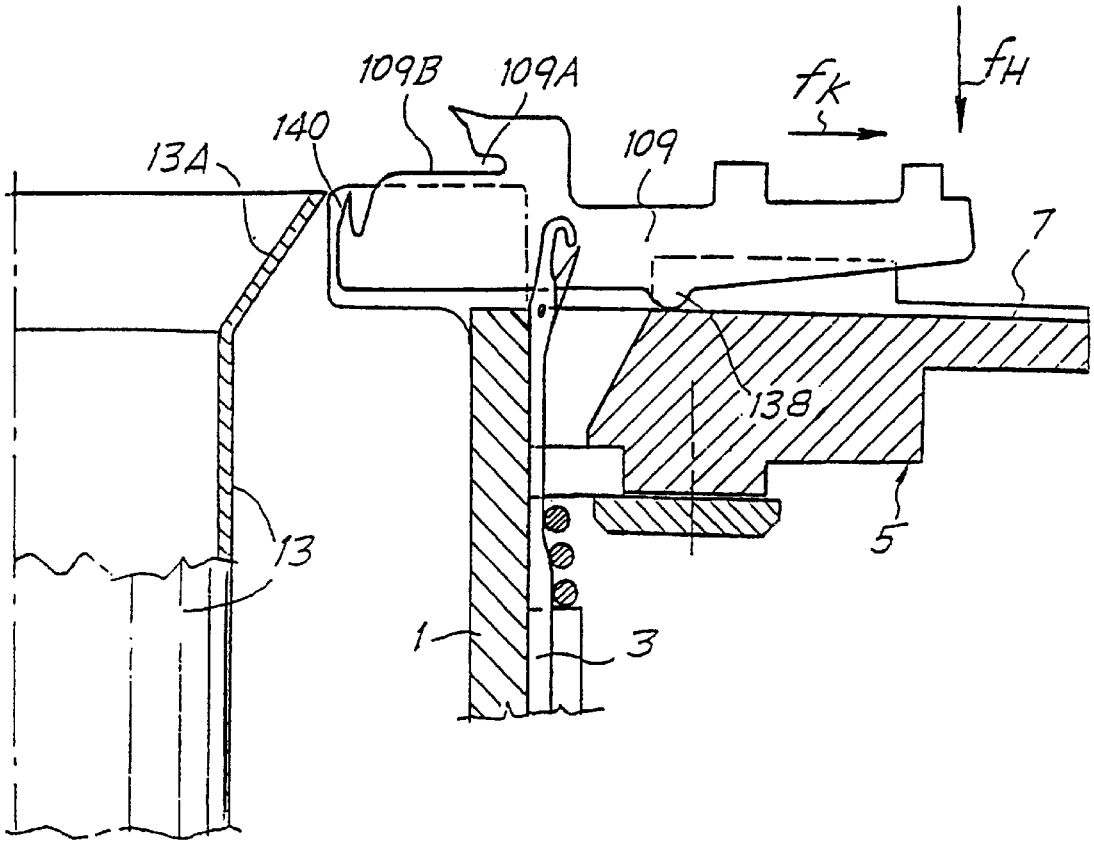
FIG. 19 shows a modified version for the intervention of the sinkers in the second stage of transferring the initial edge of the toe pouch.

The alternative version shown in FIG. 19 uses a type of sinker 109 which has, like sinker 9, a throat 109A, a surface 109B for cooperation with the needles and a spike 140 like the spike 40 of sinker 9. Sinker 109 does not have the projection 38 of sinker 9, but has a point of contact 138 at an intermediate position along its bottom surface, in such a way that this sinker can pivot like a rocker; when acted upon by cams of the ring operating the sinkers that act in the directions of the two arrows fK and fH in FIG. 19, the sinker is moved outward and its outermost end lowered, thus causing the spike 140 to emerge for a similar operation to that already described for spike 40.

Suitable components—such as cams or the like —will be provided to lower the sinkers 9 or 109 again when they are shifted back toward the axis of the needle cylinder.

It is possible to provide a suitable presser component 54 (FIG. 5) that can be brought into action to prevent the fabric from being lifted up by the needle passing through it such as needle 1S shown in FIG. 5, in such a way as to achieve smooth engagement by the needles of arc B, which must penetrate and hook onto the edge T1 of the toe fabric T before tubular working commences.

FIG. 20 shows an alternative to the version shown in FIGS. 1, 3, 4, 5 for the use of sinkers 9 (see also FIG. 18) without a modification to the needle cylinder, that is to say without resorting to the inward-projecting walls 36. In this variant, the suction tube 13 has its funnel-shaped upper orifice 13A extended to form a lip 13F for covering the innermost parts of the sinkers 9 and hence also the spikes 40. When the sinker 9 is moved out and raised (by the presence of the projection 38), the spike 40 rises immediately beyond the outward edge of the lip 13F and engages the fabric T on the free initial edge T1.

It will be understood that the drawing shows only an illustrative embodiment given purely by way of a practical demonstration of the invention, it being possible for said invention to be varied as regards shapes and arrangements without thereby departing from the scope of the concept underlying said invention.

I claim:

1. A method for closing a toe of a tubular article, the method comprising the steps of:

providing a circular knitting machine with a needle ring and first and second arcs of needles;

forming fabric for a toe pouch by the needles of said first arc, said toe pouch having an initial free edge;

transferring said initial free edge of said toe pouch to the needles of said second arc, said transferring including creating a suction of air around an inside of a portion of the needle ring to capture said initial free edge of said toe pouch adjacent said portion of the needle ring, said transferring also including moving said initial edge from said portion of the needle ring to beyond said needle ring;

engaging said initial free edge of said toe pouch over said needles of said second arc to start forming the tubular article.

2. The method as claimed in claim 1, wherein:

said moving from said portion of said needle ring is performed approximately at an end of said portion of said needle ring.

3. The method as claimed in claim 1, wherein:

said moving from said portion of said needle ring includes providing radially movable sinkers and activating said sinkers to engage said initial free edge and move said initial free edge radially out beyond said needle ring.

4. The method as claimed in claim 2, wherein:

said moving from said portion of said needle ring includes providing radially movable sinkers and activating said sinkers to engage said initial free edge and move said initial free edge radially out beyond said needle ring.

5. The method as claimed in claim 1, further comprising:

providing a pneumatic system for tensioning said fabric of said toe pouch during said forming, said tensioning being formed by suction;

switching said suction for said tensioning to said portion around said inside of said needle ring for said transferring.

6. The method in accordance with claim 1, wherein:

said portion of said needle ring is adjacent said second arc.

7. The method in accordance with claim 1, wherein:

said moving from said initial free edge includes grasping means for mechanically grasping said initial free edge adjacent said portion of said needle ring.

8. The method in accordance with claim 1, wherein:

said first and second arcs are substantially semicircular.

9. The method in accordance with claim 1, wherein:

said first and second arcs are substantially opposite each other.

10. A mechanism for closing a toe of a tubular article on a circular machine with a needle ring and first and second arcs of needles, the mechanism comprising:

toe means for controlling the needles of said first arc to form fabric for a toe pouch, said toe pouch including an initial free edge;

transfer means for transferring the initial free edge of said toe pouch to the needles of the second arc of needles for engagement of said initial free edge over the needles of the second arc in first and second stages, said first stage approaching the second arc of needles and said second stage moving said initial free edge progressively out beyond the needle ring, said transfer means includes transfer suction means fir forming a region of concentrated suction of air in a fixed position around an inside of a portion of the needle ring for performing said first stage.

11. The mechanism as claimed in claim 10, wherein:

said transfer suction means includes a transfer suction pipe with an elongate arcuate suction mouth at an end of said transfer suction pipe, suction in said transfer suction pipe being controlled by activation of one of a valve means and a control means.

12. The mechanism as claimed in claim 11, further comprising:

a pneumatic suction-type system for tensioning the tubular article during formation, said system including a tension suction pipe with a funnel-shaped inlet orifice on an end of said tension suction pipe, said tension suction pipe extending up an inside of said needle cylinder, said elongate suction orifice is combined with said funnel-shaped inlet orifice and with said tension suction pipe;

said valve means being capable of closing said suction pipe to concentrate a suction draft into said elongate suction mouth.

13. The mechanism as claimed in claim 10, further comprising:

a pneumatic suction-type tensioning system with a funnel-shaped inlet orifice inside the needle cylinder;

a flat component defining a cutout on an edge of said flat component, said flat component being movable to cover said funnel shaped inlet orifice with exception of said slot, said slot forming a portion of said transfer suction means.

14. The mechanism in accordance with claim 13, wherein:

said flat component is elastically bendable.

15. The mechanism as claimed in claim 10, wherein:

said transfer means includes a plurality of raisable sinkers for actuation of said second stage of progressively moving said initial free edge of the toe pouch out beyond the needle ring, said plurality of sinkers being located in the second arc with respective guiding tricks, each of said sinkers including a spike pointing toward the fabric, said plurality of sinkers being radially movable and raisable from said respective guiding trick to cause a respective said spike to project out during a supplementary centrifugal movement in which said spike penetrates the fabric on the initial free edge of the toe pouch and so moves the fabric until the fabric comes over and outside the needle ring.

16. The mechanism as claimed in claim 15, wherein:

each of said sinkers has a downward projection on an innermost end which is acted on by a shaped bottom of said respective guiding trick, so that a respective said sinker is raised by supplementary centrifugal movement.

17. The mechanism as claimed in claim 15, wherein:

each of said sinkers is tiltable in said respective guiding trick and is lowered at an outermost end of a respective said sinker at one of the start of and immediately before said supplementary centrifugal movement.

18. The mechanism as claimed in claim 15, further comprising:

a pneumatic suction-type tensioning system with a funnel-shaped inlet orifice inside the needle cylinder, said funnel-shaped orifice has an end with a lip extending over said sinkers, said spikes and up to a line to which said spikes are withdrawn and at which said sinkers rise.

19. The mechanism as claimed in claim 16, further comprising:

a pneumatic suction-type tensioning system with a funnel-shaped inlet orifice inside the needle cylinder, said funnel-shaped orifice has an end with a lip extending over said sinkers, said spikes and up to a line to which said spikes are withdrawn and at which said sinkers rise.

20. The mechanism as claimed in claim 17, further comprising:

a pneumatic suction-type tensioning system with a funnel-shaped inlet orifice inside the needle cylinder, said funnel-shaped orifice has an end with a lip extending over said sinkers, said spikes and up to a line to which said spikes are withdrawn and at which said sinkers rise.

* * * * *